US005579569A

United States Patent [19]

Tippins et al.

[11] Patent Number: 5,579,569

[45] Date of Patent: Dec. 3, 1996

[54] SLAB CONTAINER

[75] Inventors: George W. Tippins; John E. Thomas, both of Pittsburgh, Pa.

[73] Assignee: Tippins Incorporated, Pittsburgh, Pa.

[21] Appl. No.: 371,135

[22] Filed: Jan. 11, 1995

Related U.S. Application Data

[63] Continuation-in-part of Ser. No. 123,149, Sep. 20, 1993, which is a continuation of Ser. No. 881,615, May 12, 1992, Pat. No. 5,276,952.

[51] Int. Cl.[6] ..... B21B 1/46

[52] U.S. Cl. ..... 29/527.7; 164/476

[58] Field of Search ..... 29/527.7; 432/128; 164/476

[56] References Cited

U.S. PATENT DOCUMENTS

| | | | |
|---|---|---|---|
| 4,217,095 | 8/1980 | Tokitsu | 164/476 X |
| 4,229,878 | 10/1980 | Ushijima | 29/527.7 |
| 4,630,352 | 12/1986 | Ginzburg et al. | 29/527.7 |
| 4,698,897 | 10/1987 | Frommann et al. | 29/527.7 |
| 4,793,169 | 12/1988 | Ginzburg | 72/240 |
| 4,829,656 | 5/1989 | Rohde | 29/527.7 |
| 4,918,803 | 4/1990 | Di Giusto | 29/527.7 X |
| 4,942,656 | 7/1990 | Benedetti et al. | 29/527.6 |
| 4,958,677 | 9/1990 | Kimura | 164/452 |
| 4,986,341 | 1/1991 | Masuda et al. | 29/527.7 X |
| 4,998,338 | 3/1991 | Seidel et al. | 29/527.7 X |
| 5,020,208 | 6/1991 | Feldmann et al. | 432/128 X |
| 5,082,047 | 1/1992 | Bricmont | 164/476 |
| 5,113,678 | 5/1992 | Mannaka et al. | 72/8 |
| 5,121,873 | 6/1992 | Sekiya et al. | 228/170 |
| 5,133,205 | 7/1992 | Rostik et al. | 72/200 |
| 5,150,597 | 9/1992 | Sekiya et al. | 72/229 |
| 5,212,856 | 5/1993 | Di Giusto et al. | 29/527.7 X |
| 5,461,770 | 10/1995 | Kimura et al. | 29/527.7 |

FOREIGN PATENT DOCUMENTS

| | | | |
|---|---|---|---|
| 60-255201 | 12/1985 | Japan | 29/527.7 |
| 62-54501 | 3/1987 | Japan | 29/527.7 |

OTHER PUBLICATIONS

Grubbauer, Karl, et al., "Revamping potential in the finishing shop of slab caster facilities" (7 pages), Feb. 20, 1992.

*Primary Examiner*—Carl J. Arbes

*Attorney, Agent, or Firm*—Webb Ziesenheim Bruening Logsdon Orkin & Hanson, P.C.

[57] ABSTRACT

A method and apparatus of making coiled plate, sheet in coiled form or discrete plate. The apparatus is an intermediate thickness slab caster with a slab storage container and inline hot strip and plate line. The apparatus includes a continuous strip caster forming a strand of between 3.5 and 6 inches thick; a cutoff for cutting the strand into a slab of desired length; a slab table; a slab storage container adjacent to the slab conveyor table adapted to selectively receive slabs from the slab conveyor table; a reheat furnace having an entry inline with both the slab conveyor table and the slab collection and storage area for receiving slabs from either; a feed and run back table at the exit of the reheat furnace; a hot reversing mill for reducing the slab to a coiling thickness; a pair of coiler furnaces located on opposite sides of the hot reversing mill; and a finishing line downstream of the pair of coiler furnaces.

20 Claims, 5 Drawing Sheets

SLAB CONTAINER

This is a continuation-in-part of U.S. patent application Ser. No. 08/123,149 filed on Sep. 20, 1993, which is a continuation of U.S. patent application Ser. No. 07/881,615 filed on May 12, 1992, now U.S. Pat. No. 5,276,952.

FIELD OF THE INVENTION

This invention relates to the continuous casting and rolling of slabs and more particularly to an integrated intermediate thickness caster with a slab storage container and a hot reversing mill.

BACKGROUND OF THE INVENTION

Since the advent of continuous casting of slabs, the steel industry tried to successfully combine the hot strip mill and the continuous caster through an inline arrangement so as to maximize production capability and minimize the equipment and capital investment required. The initial efforts cast slabs 6 inches to 10 inches thick. These mills included a reheat furnace, a rougher and a six or seven stand finishing mill with a capacity of 1 ½ to 5 million tons per year. It is unlikely that new hot strip mills of this design would ever be built due to the high capital cost and inflexibility as to product mix and thus market requirements.

These difficulties gave rise to the development of the so-called 2 inch or less thin slab continuous hot strip mill which typically produces 1,000,000 tons of steel per year as specialized products. However, thin slab casters have serious drawbacks regarding the quality and quantity limitations. These limitations are discussed in detail in parent application Ser. No. 08/123,149 filed on Sep. 20, 1993, which is herein incorporated by reference.

The integration of a slab caster with any hot rolling mill requires a synchronizing of the casting and rolling of slabs. Without the ability to decouple the casting and rolling of slabs in such an integrated system, a breakdown anywhere in the process stops the entire line, possibly resulting in the scrapping of the entire product then being processed. The casting and rolling of slabs can be effectively decoupled by providing the ability to transfer a cast slab to a slab storage area. However, this solution is inefficient. The slab is transferred to an external slab storage area such that when the mill is brought back on-line, a substantial amount of energy is required to bring the slabs back to an appropriate rolling temperature. Several other approaches have been attempted to address this particular problem. These include retaining or storing hot slabs in a heating furnace or in a thermal insulating chamber. However, these solutions have also had certain drawbacks including the space required and the capital expense involved.

It is an object of our invention to integrate an intermediate thickness slab caster with a hot reversing mill. It is a further object to adopt a system which balances the rate of the caster to the rate of the rolling mill and provides a slab storage container for decoupling the caster and the mill. It is also an object of our invention to adopt a system using less thermal and electrical energy. It is still a further object to adopt an automated system with small capital investment, reasonable floor space requirements, reasonably powered rolling equipment and low operating costs.

SUMMARY OF THE INVENTION

Our invention provides an integrated caster and minimill producing 650,000 finished tons a year or more and producing product 24 inches to 120 inches wide of 1,000 PIW.

The casting facility has a fixed and adjustable width mold with a straight rectangular cross section without the trumpet type mold. The caster mold contains enough liquid volume to make flying tundish changes, thereby not limiting the caster run to a single tundish life. Our invention provides a slab approximately twice as thick as the thin cast slab, thereby losing much less heat and requiring a lesser input of Btu's of energy and having a lesser scale loss due to reduced surface area per volume and permits the use of a reheat or equalizing furnace with minimal maintenance required. Further, the caster can operate at conventional caster speeds and conventional descaling techniques. The optimum thickness cast slab is used in conjunction with a hot reversing mill to provide a balanced production capability. Our invention has the ability to efficiently separate the casting from the rolling if there is a delay in either end. One method of this separation is the provision of an efficient slab container. In addition, our invention provides for the easy removal of transitional slabs formed when molten metal chemistry changes or width changes are made in the caster.

All of the above advantages are realized while maintaining the advantages of a thin caster which include low ferrostatic head, low weight of slab, straight molds, shorter length molds, smaller required mold radius, low cooling requirements, low burning costs or shear capacity, and simplified machine constructions.

Our invention provides an intermediate thickness slab caster integrated with a hot strip and plate line which includes a slab storage container capable of receiving slabs from the caster, a reheat or equalizing furnace capable of receiving slabs directly from the caster, from the slab storage container or from a slab collection and storage area positioned adjacent the slab conveyor table exiting the continuous caster. A feed and run out table is positioned at the exit end of the reheat furnace and inline with a hot reversing mill having a coiler furnace positioned on either side thereof. The mill has the capability of reducing the cast slab to a thickness of about 1 inch or less in three flat passes. The combination coil, coiled plate, sheet in coil form or discrete plate finishing line extends inline and downstream of the hot reversing mill with its integral coiler furnaces. The finishing facilities include a cooling station, a downcoiler, a plate table, a shear, a cooling bed crossover, a plate side and end shear and a piler.

To achieve the necessary balance between the hot reversing mill and the caster, it is necessary to produce slabs having a thickness between 3.5 inches to 6 inches, preferably between 3.75 inches to 5 inches. The slabs are reduced to about 1 inch or less in three flat passes on a single stand hot reversing mill before starting the coiling of the intermediate product between the coiler furnaces as it is further reduced to the desired finished product thickness. In order to provide the capability of making coiled plate, discrete plate and sheet in coil form up to 1,000 PIW and higher, slab width may vary from 24 to 120 inches.

A preferred method of operation includes feeding a sheared or torch cut slab from the caster onto a slab table which either feeds directly into a slab storage container or a reheat or equalizing furnace or into a slab collection and storage area adjacent to the slab table. The preferred method further includes feeding the slab directly into the furnace from the slab table. However, the method allows for the feeding of a previously collected and stored slab into the furnace for further processing.

The slab storage container according to the present invention is adapted to selectively receive slabs from the caster, such as when there is a delay downstream. The slab container includes a vertically movable carriage adapted to engage a lowermost slab and a stack of the slabs, wherein the slabs in the stack are directly contacting each other. Insulation may be provided to surround at least the sides and top of the stack. In one embodiment of the invention, the carriage may be mounted on a track within an insulated slab holding pit with a cover adapted to enclose the slab holding pit. In a second embodiment, the carriage may include one or two pairs of slab engaging arms adapted to engage and support a lowermost slab in the stack of slabs. The slab engaging arms are preferably movable to accommodate varying slab widths and include insulating side and top members attached to each slab engaging arm. The top members of the insulation on respective slab engaging arms are configured to overlap each other, allowing for movement of the slab engaging arms to accommodate the varying widths of the slabs.

These and other objects of the present invention will be clarified in the description of the preferred embodiments taken together with the attached figures wherein like reference numerals represent like characters throughout.

DESCRIPTION OF THE PREFERRED EMBODIMENTS

Figure 1:
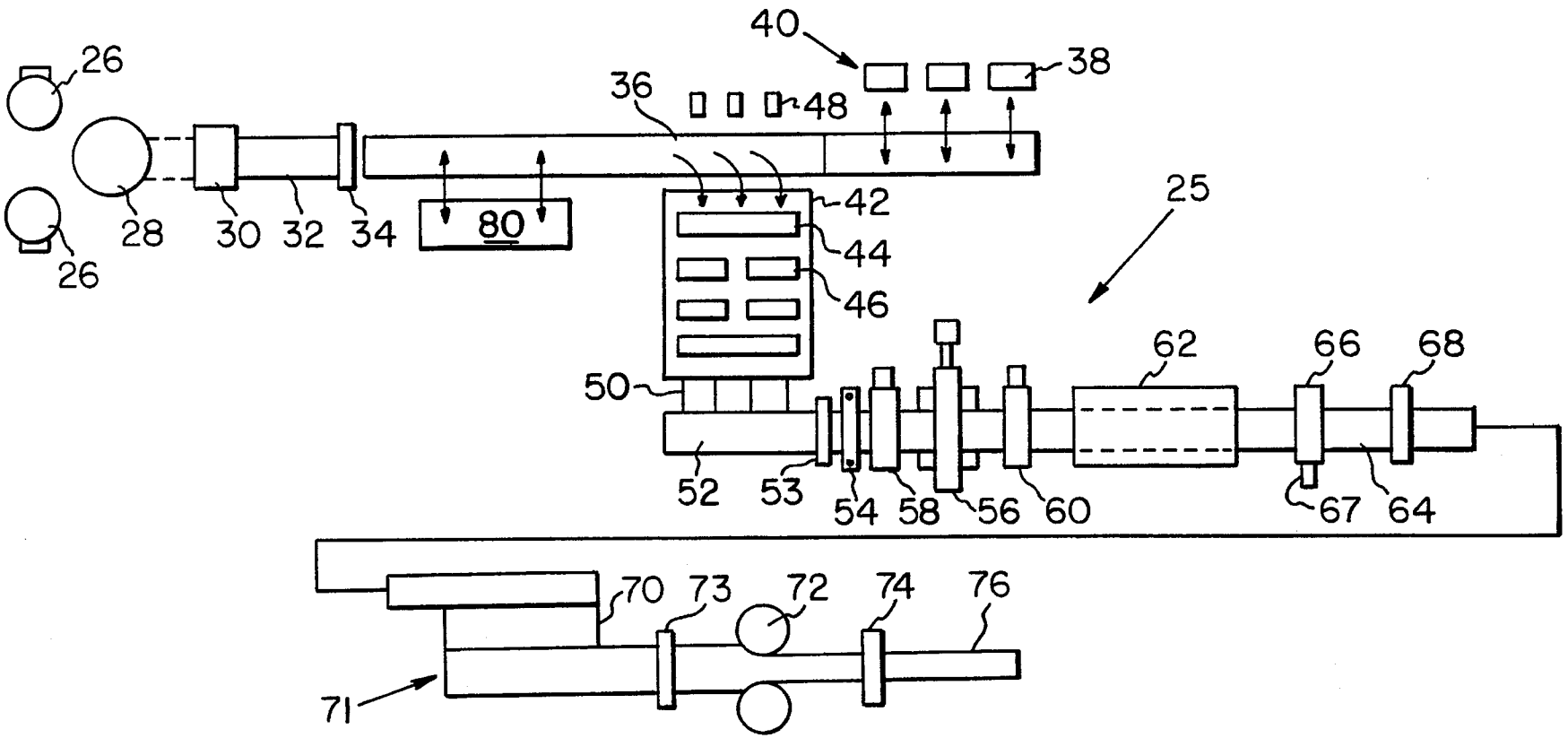
FIG. 1 is a schematic illustrating an intermediate thickness strip caster and inline hot reversing mill and coiler furnace arrangement according to the present invention.

The intermediate thickness slab caster and inline hot strip and plate line of the present invention is illustrated in FIG. 1. One or more electric melting furnaces 26 provide the molten metal at the entry end of our combination caster and strip and plate line 25. The molten metal is fed into a ladle furnace 28 prior to being fed into the caster 30. The caster 30 feeds into a curved or straight mold 32 of rectangular cross section.

A shear or torch cutoff 34 is positioned at the exit end of the mold 32 to cut the strand of now solidified metal into a 3.5 to 6 inch thick slab of the desired length which also has a width of 24 to 120 inches.

The slab then feeds on a table conveyor 36 to a slab takeoff area where it is directly charged into a furnace 42 or is stored in slab storage container 80 or alternatively is removed from the inline processing and stored in a slab collection area 40. If the cast slab is needed to be stored prior to rolling, such as due to maintenance on the rolling mill, it is preferred that the slabs be stored in the slab storage container 80. The slab collection area 40 will generally be utilized where additional processing of a slab is required, such as surfacing of the slab by hand scarfing. The preferred furnace is of the walking beam type although a walking hearth furnace could also be utilized in certain applications. Full-size slabs 44 and discrete length slabs 46 for certain plate products are shown within walking beam furnace 42. Slabs 38 which are located in the slab collection area 40 may also be fed into the furnace 42 by means of slab pushers 48 or charging arm devices located for indirect charging of walking beam furnace 42 with slabs 38. It is also possible to charge slabs into furnace 42 from the slab storage container 80 which feed onto the table conveyor 36. Because the intermediate thickness slabs retain heat to a much greater extent than the thin slabs, temperature equalization is all that is required in many modes of operation. Of course, where slabs are introduced from off-line locations, the furnace must have the capacity to add Btu's to bring the slabs up to rolling temperatures. The slab storage container 80 will minimize the need for such off-line slab loading.

The various slabs are fed through the furnace 42 in a conventional manner and are removed by slab extractors 50 and placed on a feed and run back table 52. Descaler 53 and/or a vertical edger 54 can be utilized on the slabs. A vertical edger normally could not be used with a slab of only 2 inches or less.

Downstream of feed and run back table 52 and vertical edger 54 is a hot reversing mill 56 having an upstream and a downstream coiler furnace 58 and 60, respectively. Cooling station 62 is downstream of coiler furnace 60. Downstream of cooling station 62 is a coiler 66 operated in conjunction with a coil car 67 followed by a plate table 64 operated in conjunction with a shear 68. The final product is either coiled on coiler 66 and removed by coil car 67 as sheet in strip or coil plate form or is sheared into plate form for further processing inline. A plate product is transferred by transfer table 70 which includes a cooling bed onto a final processing line 71. The final processing line 71 includes a plate side shear 72, plate end shear 74 and plate piler 76.

Many of the advantages of the subject invention are the result of the operating parameters employed. The cast strand should have a thickness between3.5 inches to 6 inches, preferably between 3.75 inches to 5 inches. The width can generally vary between 24 inches and 100 inches to produce a product up to 1,000 PIW and higher.

The slab after leaving walking beam furnace 42 is flat passed back and forth through single stand hot reversing mill 56 in no more than three passes achieving a slab thickness of about 1 inch or less. The intermediate product is then coiled in the appropriate coiler furnace, which in the case of three flat passes would be downstream coiler furnace 60. Thereafter, the intermediate product is passed back and forth through hot reversing mill 56 and between the coiler furnaces to achieve the desired thickness for the sheet in coil form, the coil plate or the plate product. The number of passes to achieve the final product thickness may vary but normally may be done in nine passes which include the initial flat passes. On the final pass, which normally originates from upstream coiler furnace 58, the strip of the desired thickness is rolled in the hot reversing mill and continues through the cooling station 62 where it is appropriately cooled for coiling on a coiler 66 or for entry onto a plate table 64. If the product is to be sheet or plate in coil form, it is coiled on coiler 66 and removed by coil car 67. If it is to go directly into plate form, it enters plate table 64 where it is sheared by shear 68 to the appropriate length. The plate thereafter enters a transfer table 70 which acts as a cooling bed so that the plate may be finished on final processing line 71 which includes descaler 73, side shear 72, end shear 74 and piler 76.

Examples illustrating the wide range of products that can be produced in the present invention are presented in the above-identified parent application which has been incorporated by reference herein.

The intermediate thickness continuous caster and hot strip and plate line provide many of the advantages of the thin strip caster without the disadvantages. The basic design of the facility can be predicated on rolling 150 tons per hour on the rolling mill. The market demand will obviously dictate the product mix, but for purposes of calculating the required caster speeds to achieve 150 tons per hour of rolling, one can assume the bulk of the product mix will be between 36 inches and 72 inches. A 72 inch slab rolled at 150 tons per hour would require a casting speed of 61 inches per minute. At 60 inches of width, the casting speed increases to 73.2 inches per minute; at 48 inches of width, the casting speed increases to 91.5 inches per minute; and at 36 inches of width, the casting speed increases to 122 inches per minute. All of these speeds are within acceptable casting speeds.

The annual design tonnage can be based on 50 weeks of operation per year at 8 hours a turn and 15 turns per week for 6,000 hours per year of available operating time assuming that 75% of the available operating time is utilized and assuming a 96% yield through the operating facility, the annual design tonnage will be approximately 650,000 finished tons.

Figure 2:
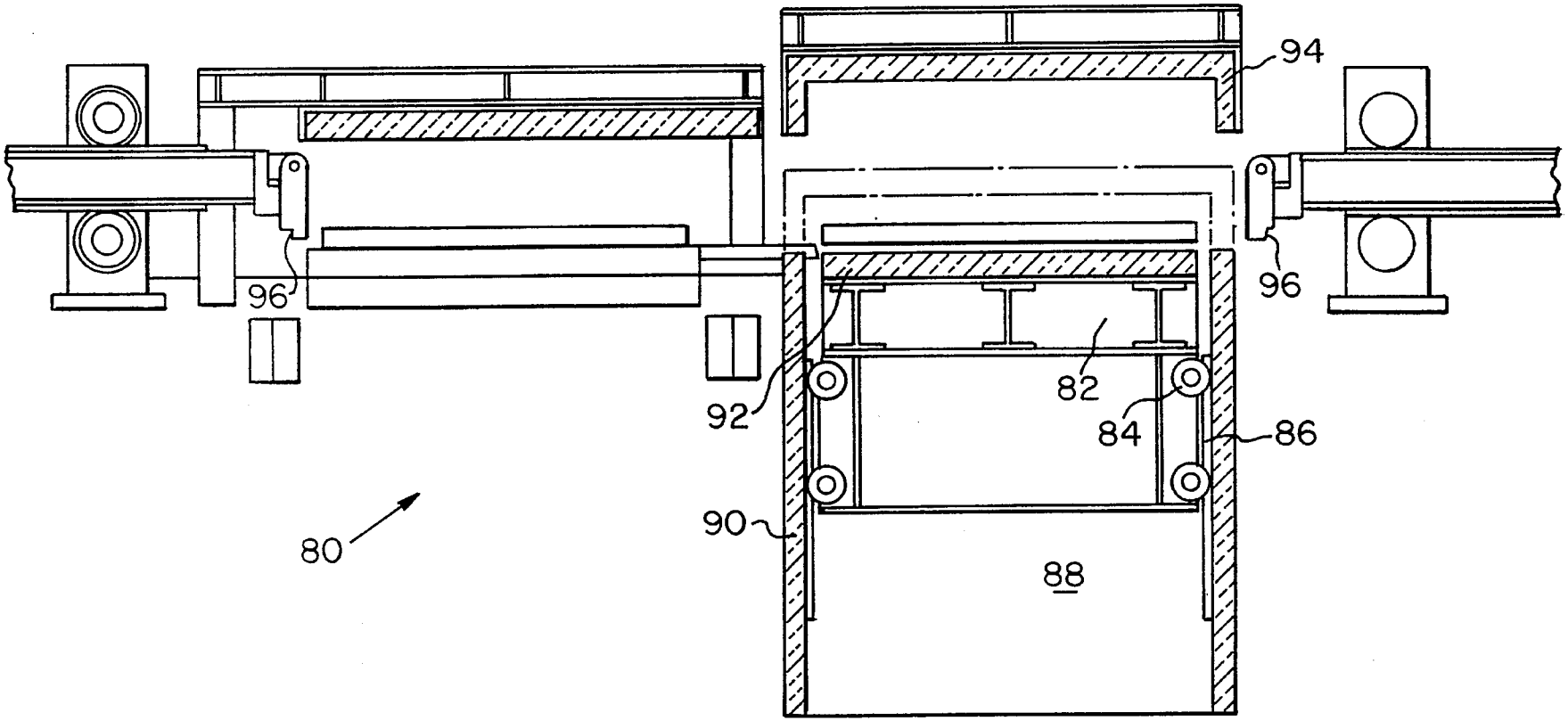
FIG. 2 is a sectional view of one embodiment of a slab storage container shown schematically in FIG. 1.

FIG. 2 illustrates a slab storage container 80 according to a first embodiment of the present invention. The slab storage container 80 includes a carriage 82 mounted by rollers 84 onto a track 86 located within a slab holding pit 88. The walls 90 of the slab holding pit 88 are appropriately insulated as is the top surface 92 of the carriage 82 which engages and supports the lowermost slab of a stack of slabs. An insulated movable cover 94 is provided for covering the slab holding pit 88 and the stack of slabs, as shown in phantom in FIG. 2. Slab pushers 96 are provided for moving slabs into and out of the stack in the slab storage container 80. The slab storage container 80 operates as follows. The lowermost slab of the stack of slabs is pushed onto the top surface 92 of the carriage 82 by slab pushers 96. Carriage 82 is then indexed down a distance substantially equal to the thickness of the slab whereby a second slab can be pushed by slab pusher 96 directly on top of the initial slab. When the stack of slabs has been placed into the slab storage container 80, the cover 94 can be positioned on top of the slab holding pit 88 to maintain the heat within the slabs.

The configuration of the slab storage container 80 provides a simple and effective means for storing a stack of slabs which also minimizes the space required. Furthermore, stacking the slabs directly on top of each other and maintaining the stacked slabs in contact with each other gives the thermal advantages of a thicker slab. The temperature loss of the individual slabs is minimized with this stacked arrangement.

Figure 3:
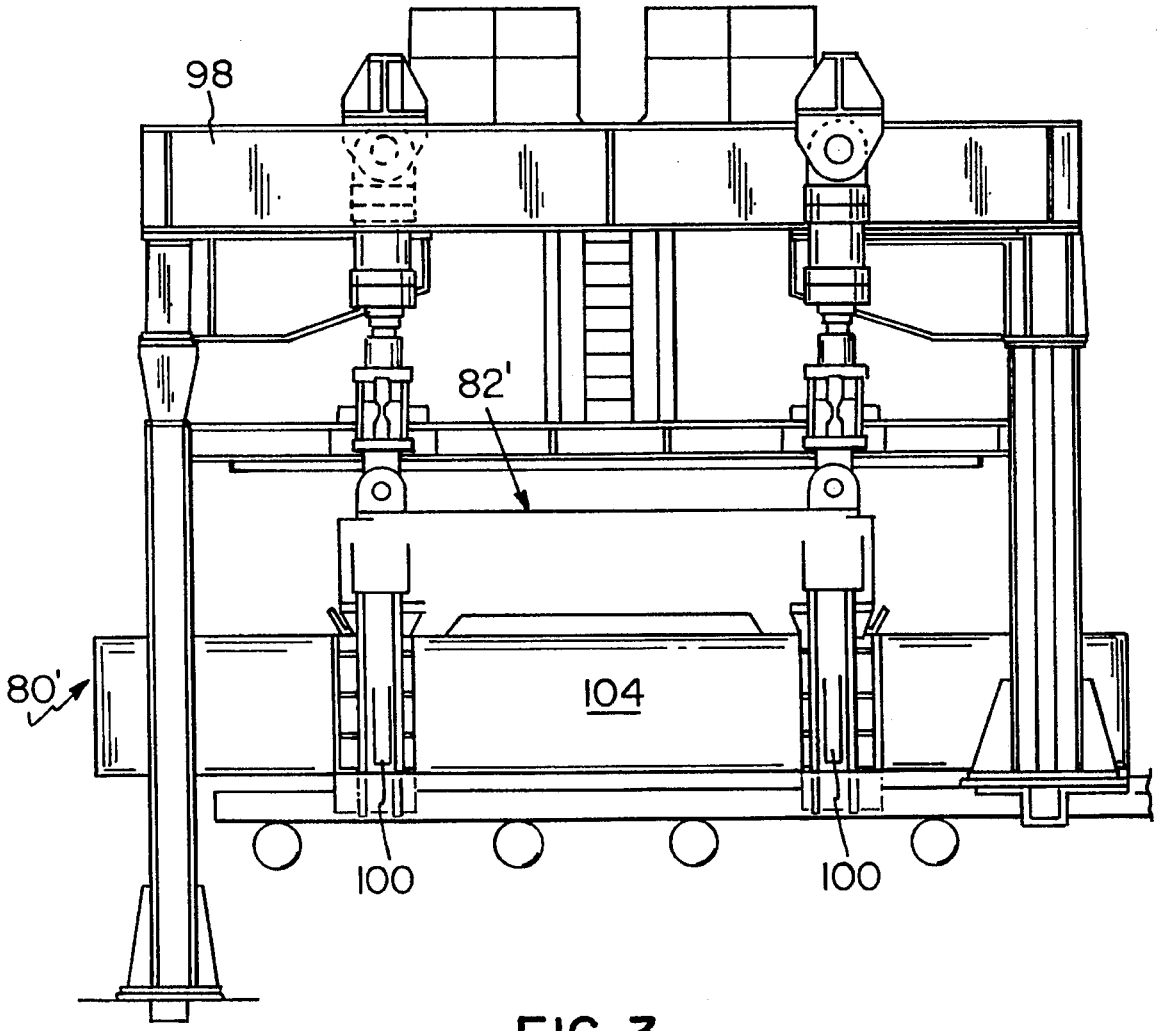
FIG. 3 is a side view of another embodiment of a slab storage container shown schematically in FIG. 1.
Figure 4:
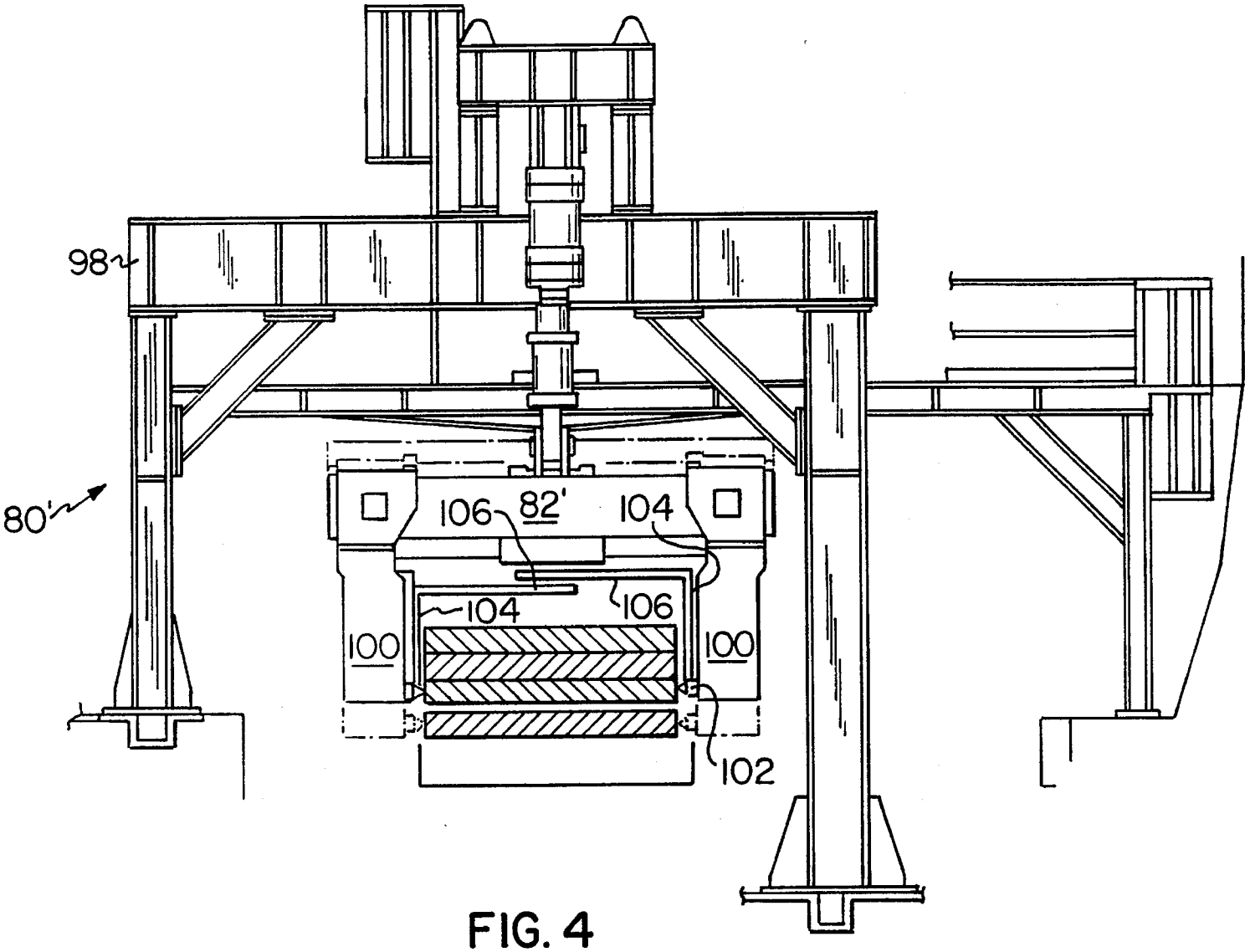
FIG. 4 is a front view of the slab storage container shown in FIG. 3.

FIG. 3 is a side view of another embodiment of a slab storage container 80' according to the present invention. The slab storage container 80' includes a carriage 82' supported on a frame 98. The carriage 82' is vertically movable on the frame 98. The carriage 82' includes a front and back pair of slab engaging arms 100. As shown in FIG. 4, engaging points 102 of each engaging arm 100 engage the sides of a lowermost slab in a stack of slabs to engage and support the stack of slabs. Preferably, the slab engaging arms 100 are hydraulically operated to move into and out of engagement with the slabs. In addition to moving in and out of engagement with the slabs, the slab engaging arms 100 are preferably movable to accommodate various widths of the slabs. Side insulating plate 104 and top insulating plate 106 are attached to each slab engaging arm 100. As illustrated in FIG. 4, the top insulating plates 106 of opposed slab engaging arms. 100 will overlap with each other to allow for the movement of the slab engaging arms 100 which provide for the accommodation of varying widths of the slabs.

The slab storage container 80' operates in a manner similar to the slab storage container 80 described above and provides similar advantages. In operation, the carriage 82' is lowered to a position over a slab and the slab engaging arms 100 are activated to securely clamp the slab therebetween and the carriage 82' is again raised holding the slab therein. To add a second slab to the slab stack, the carriage 82' is lowered, positioning the slab on top of the second slab to be positioned in the stack. Slab engaging arms 100 are disengaged from the first slab carriage moved down to align the engaging points 102 with the new lowermost slab in the stack and the slab engaging arms 100 engage to contact the new lowermost slab in the stack of slabs. This process is repeated until all of the slabs are positioned within the stack and the process is reversed for removing the slabs from the stack.

As discussed above, the slab storage container 80' provides the advantages of minimal space and efficient, effective thermal conservation of the slabs as with the slab storage container 80 described above. In addition, the slab storage container 80' provides a system that can be mounted directly over top of the slab conveyor table, further minimizing the floor space required for the overall system.

Figure 5:
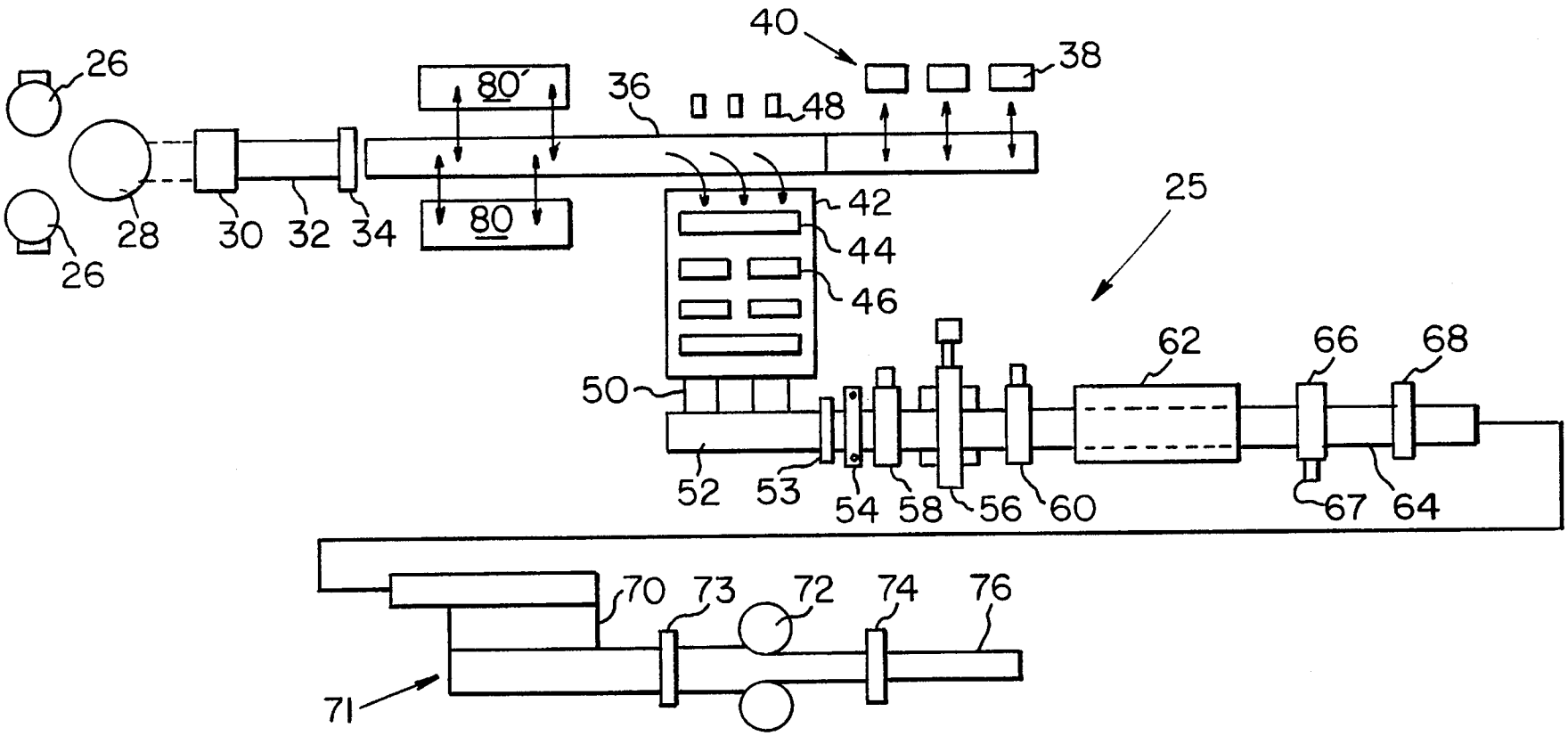
FIG. 5 is a schematic illustrating an alternative embodiment for the intermediate thickness strip caster and inline hot reversing mill and coiler furnace arrangement according to the present invention.

FIG. 5 illustrates an alternative embodiment to the caster and inline mill illustrated in FIG. 1. FIG. 5 is identical to FIG. 1 except that a plurality of slab storage containers 80 and 80' is provided adjacent the table conveyor 36. A second slab storage container 80' obviously provides additional capacity for storing cast slabs in the event of a delay downstream. However, the addition of a second or more slab storage container 80' also provides slab sequencing possibilities. This allows for a certain prioritization and changing of the order of slabs by directing them to appropriate slab storage containers from which the slabs can be selectively withdrawn.

From the present disclosure, it will be apparent to those of ordinary skill in the art that various modifications may be made to the present invention without departing from the spirit and scope thereof. Consequently, the present invention is intended to be defined by the attached claims.

What is claimed is:

1. A method of making coiled plate, sheet in coil form or discrete plate comprising the steps of:

a) continuously casting a strand having an intermediate thickness;

b) cutting said strand into a slab of predetermined length;

c) selectively feeding said slab into a vertically stacking slab container;

d) feeding said slab into an inline heating furnace;

e) extracting said slab onto a continuous processing line including a hot reversing mill having a coiler furnace on each of an upstream side and downstream side thereof;

f) flat passing said slab back and forth through said mill to form an intermediate product of a thickness sufficient for coiling after a number of passes through said mill;

g) passing said intermediate product through said mill to further reduce its thickness and coiling said intermediate product in one of said upstream or downstream coiler furnaces;

h) passing said coiled intermediate product back and forth through said mill to reduce said coiled intermediate product to an end product of desired thickness, said intermediate product being collected in and fed out of each of said coiler furnaces on each pass through the mill; and i) finishing said end product into one of coiled plate, discrete plate or sheet in coil form.

2. The method of claim 1 wherein said slabs are selectively fed to said slab container when delays are encountered downstream of said furnace and including storing said slabs in said storage container upstream of said furnace for the length of said delay prior to charging said slabs into said furnace.

3. The method of claim 1 wherein said selective feeding of said slabs to said slab storage container includes the step of directly stacking slabs fed to said container directly on top of each other.

4. A slab container positioned between a continuous caster and a rolling mill adapted to selectively receive slabs from said caster, said container including a vertically movable carriage adapted to engage a lowermost slab in a stack of said slabs within said container, wherein said slabs in said stack are directly contacting each other, and wherein said carriage includes at least one pair of slab engaging arms adapted to engage and support a lowermost slab in said stack of slabs.

5. The slab container of claim 4 further including insulation surrounding at least the sides and top of said stack.

6. The slab container of claim 4 wherein said slab engaging arms are movable to accommodate varying slab widths.

7. The slab container of claim 4 further including an insulating side and top member attached to each said slab engaging arm.

8. An intermediate thickness slab caster and inline hot strip and plate line comprising:

a) a continuous strip caster means for forming an intermediate thickness strand;

b) an inline cutoff downstream of said caster means for cutting said strand to a slab of a desired length;

c) a slab conveyor table inline with said cutoff;

d) a vertically stackable slab storage container adapted to receive slabs from said slab conveyor table;

e) a reheat furnace having an entry end inline with said slab conveyor table for receiving slabs therefrom;

f) a feed and run back table positioned at an exit end of said reheat furnace;

g) a hot reversing mill means inline with said feed and run back table for reducing said slab exiting the reheat furnace to an intermediate product of a thickness sufficient for coiling; and h) a pair of coiler furnaces, one located upstream of said hot reversing mill means and the other located downstream, said coiler furnaces capable of receiving and paying out said intermediate product as it is passed between the coiler furnaces and through said hot reversing mill means so as to be reduced to an end product thickness.

9. The apparatus of claim 8 further including a finishing line downstream of and inline with said pair of coiler furnaces and said hot reversing mill means.

10. The apparatus of claim 9 wherein said finishing line includes in sequence a cooling station, a downcoiler, a plate table, a shear, a cooling bin crossover and plate side and end shears and a piler.

11. The apparatus of claim 8 wherein said vertically stackable slab storage container is positioned adjacent said slab conveyor table.

12. The apparatus of claim 8 wherein said slab storage container includes a vertically movable carriage for supporting a stack of said slabs.

13. The apparatus of claim 12 wherein said carriage is mounted within a slab holding pit.

14. The apparatus of claim 13 further including an insulated cover adapted to enclose said slab holding pit and said stack of slabs.

15. The apparatus of claim 12 wherein said carriage includes at least one pair of slab engaging arms adapted to engage and support a lowermost slab in said stack of slabs.

16. The apparatus of claim 15 wherein said slab engaging arms are movable to accommodate varying slab widths.

17. The apparatus of claim 15 further including insulating side and top members attached to each said slab engaging arm.

18. An intermediate thickness slab caster and inline hot strip and plate line comprising:

a) a continuous strip caster means for forming an intermediate thickness strand;

b) an inline cutoff downstream of said caster means for cutting said strand to a slab of a desired length;

c) a slab storage and sequencing means for selectively storing and sequencing selected slabs;

d) at least one reheat furnace positioned downstream of said slab storage and sequencing means;

e) a feed and run back table positioned at an exit end of said at least one reheat furnace;

f) a hot reversing mill means inline with said feed and run back table for reducing said slab exiting the reheat furnace to an intermediate product of a thickness sufficient for coiling; and g) a pair of coiler furnaces, one located upstream of said hot reversing mill means and the other located downstream, said coiler furnaces capable of receiving and paying out said intermediate product as it is passed between the coiler furnaces and through said hot reversing mill means so as to be reduced to an end product thickness.

19. The apparatus of claim 18 further including a slab conveyor table inline with said cutoff adapted to receive slabs therefrom, wherein said slab storage and sequencing means includes at least one vertically stackable slab storage container adapted to selectively receive slabs from said slab storage table.

20. The apparatus of claim 19 wherein said slab storage and sequencing means further includes a slab collection and storage area positioned adjacent said slab conveyor table.

* * * * *